United States Patent [19]

Thornthwaite

[11] Patent Number: 4,913,632

[45] Date of Patent: Apr. 3, 1990

[54] FUEL INJECTION PUMP

[75] Inventor: Ian R. Thornthwaite, Gillingham, England

[73] Assignee: Lucas Industries Public Limited Company, Birmingham, England

[21] Appl. No.: 259,853

[22] Filed: Oct. 19, 1988

[30] Foreign Application Priority Data

Oct. 22, 1987 [GB] United Kingdom ..... 8724795

[51] Int. Cl.[4] ..... F04B 39/00; F02M 41/14

[52] U.S. Cl. ..... 417/462; 417/219; 123/450; 123/387

[58] Field of Search ..... 417/462, 219, 221; 123/450, 387

[56] References Cited

U.S. PATENT DOCUMENTS

| | | | |
|---|---|---|---|
| 4,474,157 | 10/1984 | Skimmer et al. | 417/462 |
| 4,764,092 | 8/1988 | Thornthwaite | 417/462 |
| 4,770,141 | 9/1988 | Bonin | 123/450 |

FOREIGN PATENT DOCUMENTS

| | | | |
|---|---|---|---|
| 0255301 | 11/1963 | Australia | 417/462 |
| 0916617 | 3/1961 | United Kingdom | 417/462 |

*Primary Examiner*—Leonard E. Smith, Jr.
*Assistant Examiner*—David W. Scheuermann
*Attorney, Agent, or Firm*—Balogh, Osann, Kramer, Dvorak, Genova & Traub

[57] ABSTRACT

A rotary distributor fuel injection pump includes a rotary distributor member movable axially in a body part. The distributor member has a transverse bore in which is mounted a pumping plunger. At its outer end the plunger is engaged by a cam follower including a roller which is axially movable with the distributor member and which engages cam lobes formed on the internal surface of a cam ring to effect inward movement to the plunger. Outward movement of the plunger is effected by supplying fuel to the bore and the extent of outward movement of the plunger is limited by stop rings on the opposite sides of the cam ring. The stop rings are mounted in the body and define internal inclined surfaces which are engaged by end portions of the roller so that as the distributor member is moved axially the extent of outward movement of the plunger will be varied to control the amount of fuel supplied by the pump.

8 Claims, 3 Drawing Sheets

FUEL INJECTION PUMP

This invention relates to a rotary distributor type fuel injection pump of the kind comprising a rotary distributor member supported for rotation and axial movement within a body part, a drive shaft mounted in the body part and arranged in use to be driven in timed relationship with an associated engine, said drive shaft being coupled to the distributor member so as to rotate therewith, a transverse bore in the distributor member, a pumping plunger in the bore, a cam follower positioned at the outer end of the plunger, the cam follower including a roller, a cam ring surrounding the distributor member, the cam ring having inwardly extending cam lobes which engage with the roller to impart inward movement to the plunger, means for admitting fuel to the bore, a delivery passage in the distributor member communicating with the bore and opening onto the periphery of the distributor member, a plurality of outlets formed in the body part and with which the delivery passage can communicate in turn during successive inward movements of the plunger, and means for limiting the extent of outward movement of the plunger, said means being arranged so that axial movement of the distributor member will effect a variation in the allowed movement of the plunger thereby varying the amount of fuel delivered through the outlets.

An example of such a pump is known from British Specification No. 2037365 in which the drive shaft is of cup-shaped form and surrounds the distributor member in the region of the bore. The wall of the cup-shaped portion of the drive shaft is provided with a slot through which the cam follower extends and the internal surface is tapered. The cam follower includes a shoe which supports the roller and the shoe has complementary stop surfaces for engagement with the tapered surface of the cup-shaped portion of the drive shaft. The shoes are movable axially with the distributor member so that the extent of outward movement of the plungers will be varied as the distributor is moved axially.

In such a pump axial movement of the drive shaft will cause a variation in the amount of fuel supplied by the pump for a given axial setting of the distributor member.

It is usual in such pumps to have at least two pumping plungers in order to balance the load applied to the distributor member. However, due to manufacturing tolerances and possibly due to side thrust applied to the drive shaft, it is possible at the commencement of a delivery phase of the pump for one plunger only to be moved by a cam lobe followed later by movement of the other plunger or plungers. Such inward movement of one plunger will pressurise the fuel in the bore and will drive the other plunger or plungers outwardly. Such outward movement will be prevented by the stop surfaces and a substantial side loading will be applied to the drive shaft. In addition, although in certain circumstances this may be desirable, the initial delivery of fuel will be effected by one plunger only so that the rate of fuel delivery will be lower than if all the plungers were in operation.

The object of the present invention is to provide a pump of the kind specified in a simple and convenient form.

According to the invention in a pump of the kind specified the means for limiting the extent of outward movement of the plunger comprises a pair of stop rings mounted adjacent opposite sides of the cam ring respectively, the internal surfaces of said stop rings defining stop surfaces which are inclined relative to the axis of rotation of the distributor member, means locating said roller against axial movement relative to the distributor member and the end portions of said roller being shaped for co-operation with said stop surfaces respectively whereby axial movement of the distributor member will vary the extent of allowed outward movement of the plunger.

An example of a pump in accordance with the invention will now be described with reference to the accompanying drawings in which.

Figure 1:
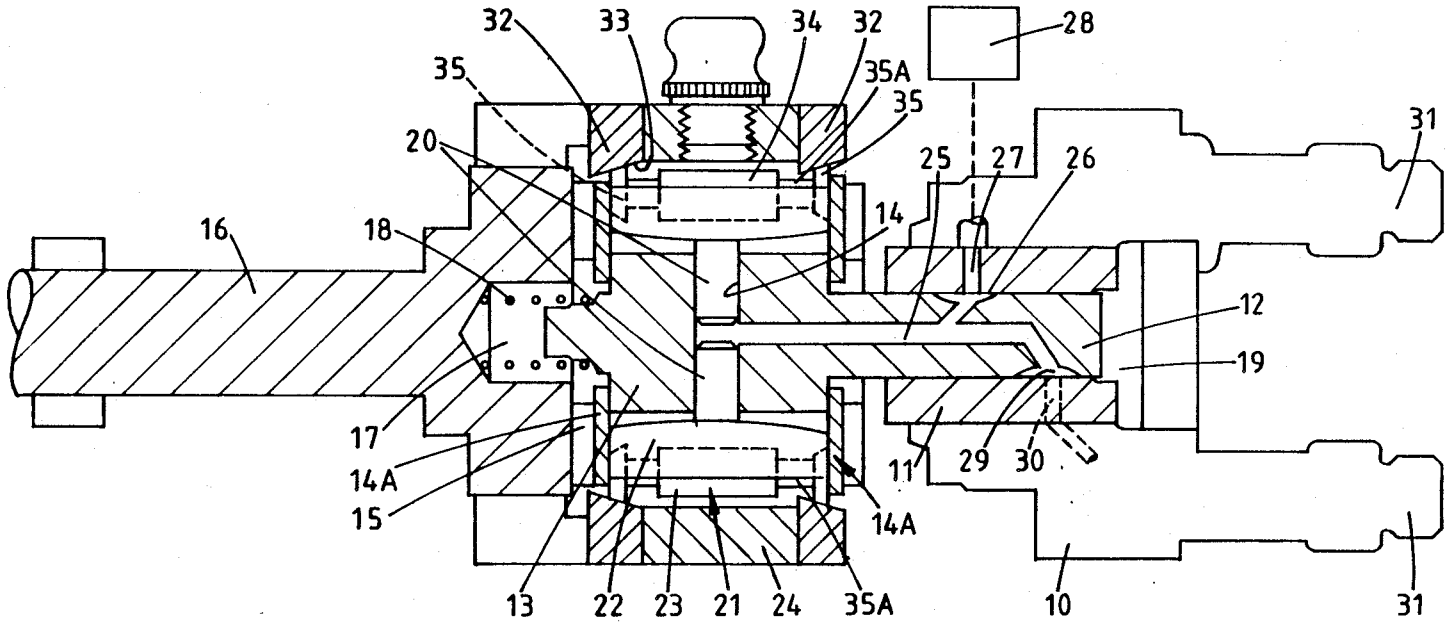
FIG. 1 is a sectional side elevation showing part of the pump.

Referring to FIG. 1 of the drawings the pump comprises a body part a portion of which is seen at 10. Mounted in the body part is a fixed sleeve 11 and rotatably mounted within the sleeve and also axially movable therein is a rotary distributor member 12. The distributor member has an enlarged portion 13 in which is formed a transversely extending bore 14. Secured to the end walls of the enlarged portion 13 are a pair of side plates 14A respectively, the side plates defining tongues which are located within slots 15 formed in a cup-shaped portion of a drive shaft 16. The drive shaft 16 is journalled within a further portion of the body part 10 and in use is arranged to be driven in timed relationship with the associated engine. The internal surface of the cup-shaped portion of the drive shaft is of plain cylindrical form and a recess 17 is formed in the base wall of the cup-shaped portion, the recess containing a coiled compression spring 18 which acts between the drive shaft and the distributor member to bias the distributor member towards the right as seen in the drawing. Movement of the distributor member towards the left is accomplished by supplying liquid under pressure to a chamber 19 which is defined at the end of the distributor member remote from the drive shaft.

Located within the transverse bore 14 are a pair of plungers 20 at the outer ends of which are located cam followers 21 respectively. Each cam follower comprises a shoe 22 which is located in the respective slot 15 in the drive shaft, and which has an inner surface for engagement with the outer end of the respective plunger 20. The cam follower also includes a roller 23 which is accommodated within a groove formed in the outer surface of the respective shoe but which projects therefrom for engagement with the internal peripheral surface of an angularly adjustable cam ring 24. The cam ring is provided with a plurality of pairs of inwardly extending cam lobes on its internal peripheral surface and in the particular example two pairs of cam lobes are provided the cam lobes of each pair being diametrically disposed and the cam lobes being equiangularly spaced about the surface of the cam ring. The pump is for supplying fuel to a four cylinder engine and communicating with the bore 14 is a longitudinal passage 25 which communicates with a first longitudinal groove 26 formed on the periphery of the distributor member. The groove 26 is positioned to communicate in turn with four equiangularly spaced inlet ports 27 formed in the sleeve 11, only one inlet port being shown. The inlet ports communicate with a source 28 of fuel under pressure and the communication of the groove 26 with a port 27 occurs during the time when the plungers are allowed to move outwardly by the cam lobes.

The passage 25 also communicates with a second longitudinal groove 29 formed on the periphery of the distributor member and this groove can communicate in turn with a plurality of outlet ports 30 formed in the sleeve and extending to outlets 31 which in use, are connected to the injection nozzles of the associated engine. The communication of the groove 29 with an outlet 30 occurs during the inward movement of the plungers.

In order to control the amount of fuel supplied by the pump to the associated engine, there is provided a pair of stop rings 32 which are located on opposite sides of the cam ring 24 and which define internal annular stop surfaces 33 the stop surfaces on each ring being inclined in the same direction relative to the axis of rotation of the distributor member. Moreover, each roller 23 includes a central portion 34 for engagement with the cam lobes and end portions 35 which are separated from the central portion 34 of the rollers by reduced portions 35A respectively. The end portions 35 have inclined surfaces for engagement with the stop surfaces 33 respectively. The rollers and also the shoes are located against axial movement relative to the distributor member by the tongues which form part of the side plates 14A.

In operation, the extent of outward movement of the plungers during the time when fuel is supplied to the bore 14 is determined by the abutment of the portions 35 of the rollers with the stop surfaces 33 and therefore the extent of outward movement depends upon the axial position of the distributor member within the body part. As previously mentioned, the axial position of the distributor member is controlled by fuel under pressure applied to the chamber 19 and therefore by varying the fuel pressure the position of the distributor member can be determined. In the particular example when the pressure in the chamber 19 is low the distributor member will be moved towards the right as seen in the drawing and the amount of fuel supplied by the pump to the associated engine will be at its maximum. As the distributor member is moved towards the left against the action of the spring 18, the quantity of fuel supplied will be reduced. It will of course be appreciated that the inclination of the stop surfaces 33 and also the surfaces on the end portions 35 of the rollers, can be reversed so that as the distributor member is moved towards the left, the amount of fuel supplied by the pump will increase.

With the arrangement described any axial movement of the drive shaft will have no influence on the quantity of fuel which is supplied by the pump to the associated engine as compared for example with the apparatus described in the aforementioned British specification No. 2037365. Moreover, any tilting of the drive shaft due to side loads applied to it will similarly have no effect on the quantity of fuel supplied by the apparatus.

Figure 2:
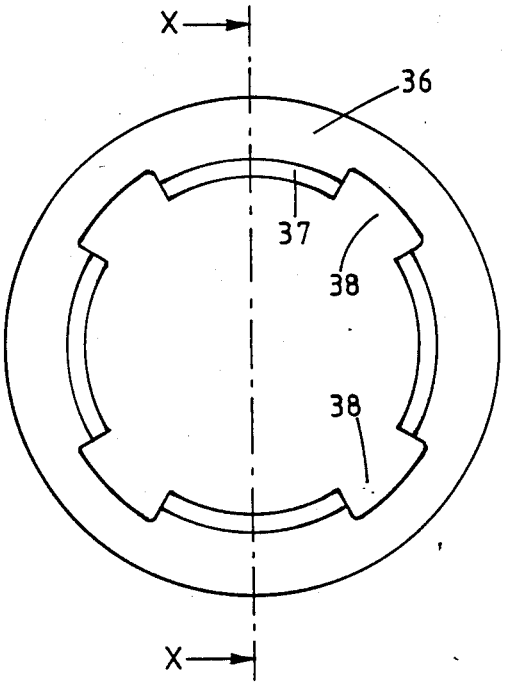
FIG. 2 is an end view of part of the pump seen in FIG. 1.

If the surfaces 33 of the stop rings 32 are continuous, it is possible for one roller to engage a cam lobe before the other roller or rollers if there are more than two plungers, thereby to pressurise the fuel within the bore 14. Pressurisation of the fuel in the bore 14 will cause the other plunger or plungers to bear against the stop rings. Thereafter fuel will be supplied to the associated engine at a restricted rate due to the fact that only one plunger is being moved inwardly. The rate of fuel delivery will of course increase as the other plungers start to move inwardly. Whilst in certain circumstances a low initial rate of fuel delivery to the associated engine may be beneficial, it is preferred that all the plungers contribute to the initial flow of fuel and it is undesirable for the stop rings to be subjected to the pressure developed during fuel delivery. The internal surfaces 33 of the stop rings are therefore modified as is shown in FIG. 2. In FIG. 2 a modified stop ring 36 is illustrated with interrupted stop surfaces 37. The interruptions in the stop surfaces 37 are achieved by machining recesses 38 in the internal surface of the stop rings, the recesses 38 corresponding to the leading flanks 40A (FIG. 4) of the cam lobes on the internal peripheral surface of the cam ring. Therefore in a pump which incorporates stop rings as shown in FIG. 2, the outward movement of the plungers 20 is controlled as described but prior to inward movement of the plungers and after the groove 26 has moved out of communication with the port 27, the control of the outward movement of the rollers and plungers by the stop rings is removed. If therefore one plunger is moved inwardly by a cam lobe the effect will be to move the other plunger or plungers outwardly into contact with the respective cam lobes and all the plungers will move inwardly at the same time under the control of the leading flanks 40A respectively of the cam lobes to effect a pumping stroke.

A problem can arise with the aforesaid modification when the distributor member is set for zero or near zero fuel. In this situation and if the cam ring 24 is set at its fully retarded position it is possible for the end portions 35 of the rollers to engage the portions of the rings 36 defining the end faces of the recesses 38, before the rollers contact the cam lobes. This will result in undesirable stress and may be overcome by extending the recesses 38 in the direction of rotation of the distributor member.

Figure 3:
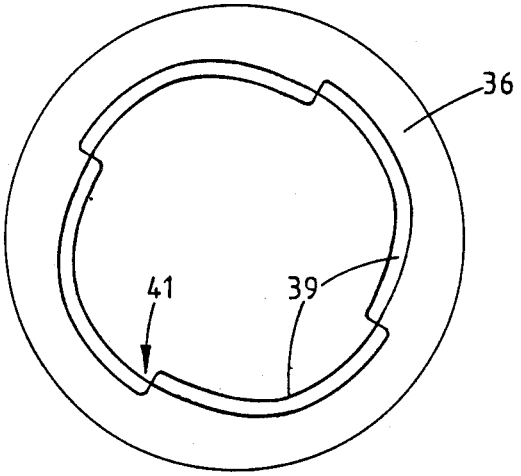
FIG. 3 shows a modification to the part of the pump seen in FIG. 2.
Figure 4:
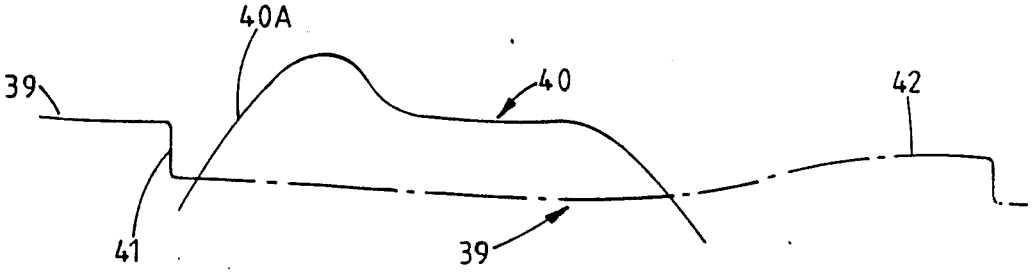
FIG. 4 is a developed view of the surface of a cam lobe and a stop ring.

As an alternative to providing the recesses 38 in which the stop surfaces 37 are machined away, the stop rings may have the form shown in FIG. 3 in which the stop surface on each ring is divided into four sections 39, for a four cylinder pump. The profile of a section 39 in relation to the profile of the associated cam lobe is seen in FIG. 4, the cam lobe being designated 40. It will be seen that there is a step 41 between adjacent sections 39 but the effective recess defined by each section extends over the whole cam lobe, the end wall of the recess returning gradually to a plateau 42 which determines the position of the rollers and plunger at the instant the supply of fuel to the bore containing the plungers is cut off.

I claim:

1. A rotary distributor fuel injection pump comprising a rotary distributor member supported for rotation and axial movement within a body part, a drive shaft mounted in the body part and in use driven in timed relationship with the associated engine, means coupling the distributor member to the drive shaft, a transverse bore in the distributor member and a pumping plunger in the bore, a cam follower positioned at the outer end of the plunger, the cam follower including a roller, a cam ring surrounding the distributor member, the cam ring having inwardly extending cam lobes which engage with the roller to impart inward movement to the plunger, means for admitting fuel to the bore, a delivery passage in the distributor member the delivery passage communicating with the bore and opening onto the periphery of the distributor member, a plurality of outlets with which the delivery passage can communicate in turn during successive inward movements of the plunger and further means for limiting the extent of outward movement of the plunger said further means being arranged so that axial movement of the distributor member will effect variation in the allowed outward movement of the plunger to vary the amount of fuel delivered through the outlets, said further means comprising a pair of stop rings mounted adjacent opposite sides of the cam ring respectively, the internal surfaces of said stop rings defining stop surfaces which are inclined relative to the axis of rotation of the distributor member, means locating said roller against axial movement relative to the distributor member and the end portions of said roller being shaped for co-operation with said stop surfaces respectively.

2. A pump according to claim 1 in which the surfaces defined by said stop rings are provided with recesses aligned with the leading flanks of the cam lobes.

3. A pump according to claim 2 in which said recesses are extended in the direction of rotation of the distributor member.

4. A pump according to claim 3 in which said recesses extend over the whole cam lobe.

5. A pump according to claim 1 in which each roller includes a central portion of a reduced axial length as compared with the length of the cam ring, end portions and reduced portions interconnecting said end portions and said central portion.

6. A pump according to claim 2 in which each roller includes a central portion of a reduced axial length as compared with the length of the cam ring, end portions and reduced portions interconnecting said end portions and said central portion.

7. A pump according to claim 3 in which each roller includes a central portion of a reduced axial length as compared with the length of the cam ring, end portions and reduced portions interconnecting said end portions and said central portion.

8. A pump according to claim 4 in which each roller includes a central portion of a reduced axial length as compared with the length of the cam ring, end portions and reduced portions interconnecting said end portions and said central portion.

* * * * *